US010378397B2

(12) United States Patent
Mori

(10) Patent No.: US 10,378,397 B2
(45) Date of Patent: Aug. 13, 2019

(54) LUBRICATION STRUCTURE FOR INTERNAL COMBUSTION ENGINE

(71) Applicant: SUZUKI MOTOR CORPORATION, Shizuoka-Ken (JP)

(72) Inventor: Masaki Mori, Shizuoka-Ken (JP)

(73) Assignee: SUZUKI MOTOR CORPORATION (JP)

( * ) Notice: Subject to any disclaimer, the term of this patent is extended or adjusted under 35 U.S.C. 154(b) by 36 days.

(21) Appl. No.: 15/858,294

(22) Filed: Dec. 29, 2017

(65) Prior Publication Data

US 2018/0238203 A1 Aug. 23, 2018

(30) Foreign Application Priority Data

Feb. 17, 2017 (JP) ..... 2017-027793

(51) Int. Cl.

| | |
|---|---|
| ***F01M 1/08*** | (2006.01) |
| ***F01M 11/02*** | (2006.01) |
| ***F01M 1/04*** | (2006.01) |
| ***F01M 1/02*** | (2006.01) |

(52) U.S. Cl.

CPC ..... *F01M 1/08* (2013.01); *F01M 1/02* (2013.01); *F01M 1/04* (2013.01); *F01M 11/02* (2013.01)

(58) Field of Classification Search

CPC .. F01M 1/08; F01M 1/04; F01M 1/02; F01M 11/02

See application file for complete search history.

(56) References Cited

U.S. PATENT DOCUMENTS 5,743,230 A * 4/1998 Yamazaki ..... F01M 1/02 123/192.2

FOREIGN PATENT DOCUMENTS

JP 2013079623 A 5/2013

* cited by examiner

*Primary Examiner* — Jacob M Amick

(74) *Attorney, Agent, or Firm* — Barnes & Thornburg LLP

(57) ABSTRACT

A lubrication structure for an internal combustion engine includes an oil pump, a main gallery, an oil-supply passage, a sub gallery, and an oil-communication passage. The oil pump is installed in a crankcase configured by connecting an upper crankcase on a mating surface of a lower crankcase from above. The main gallery is provided in the lower crankcase for supplying oil from the oil pump to the engine. The oil-supply passage is provided in the lower crankcase and supplies oil from the main gallery to a mating-surface-oil passage of the mating surface. The sub gallery is provided in the upper crankcase for guiding oil to a piston jet that injects oil toward a piston of the engine. The oil-communication passage is provided across the lower and upper crankcases, branches from the oil-supply passage to communicate with the sub gallery, and guides oil in the oil-supply passage to the sub gallery.

8 Claims, 10 Drawing Sheets

LUBRICATION STRUCTURE FOR INTERNAL COMBUSTION ENGINE

CROSS-REFERENCE TO RELATED APPLICATIONS

This application claims the benefit of priority of Japanese Patent Application No. 2017-027793, filed on Feb. 17, 2017, the entire contents of which are incorporated herein by reference.

BACKGROUND OF THE INVENTION

Field of the Invention

The present invention relates to a lubrication structure for an internal combustion engine that supplies oil to a piston jet for cooling a piston of an internal combustion engine.

Description of the Related Art

The thermal load on a piston increases with increase in an output power of an engine, so that importance of a piston jet that cools a piston by injecting oil to a back surface of the piston is increasing. A piston reciprocates in a cylinder block, and a connecting rod draws a large trajectory in response to this, so that disposition of the piston jet that injects oil to the back surface of the piston is limited to a very narrow range.

Moreover, disposition of an oil passage for supplying oil to the piston jet is also difficult, and it is also necessary to ensure oil pressure for injecting oil from the piston jet. Patent Document 1 (Japanese Patent Laid-Open No. 2013-79623) discloses a lubrication structure in which oil is supplied to a piston jet (injection nozzle) that injects oil to the piston by using oil passages (an oil conduit and an oil distribution pipe) that are externally attached to a crankcase and a cylinder block.

When the oil passage for supplying oil to the piston jet is complicated, the number of machining steps of the oil passage increases. Further, when oil is supplied to the piston jet (the injection nozzle) by using the oil passages (the oil conduit and the oil distribution pipe) externally attached to the engine as described in Patent Document 1, the number of components, the number of assembly steps, and the weight and cost of the engine increase. Further, there is a fear of oil leakage in the oil passage externally attached.

SUMMARY OF THE INVENTION

In the light of the aforementioned circumstances, an object of the present invention is to provide a lubrication structure for an internal combustion engine that can reduce a number of components and the like by simplifying an oil passage for feeding oil to a piston jet, and enhance piston cooling performance.

The above and other objects can be achieved according to the present invention by providing, in one aspect, a lubrication structure for an internal combustion engine includes an oil pump, a main gallery, an oil supply passage, a sub gallery, and an oil communication passage. The oil pump is installed in a crankcase that is configured by connecting an upper crankcase on a mating surface of a lower crankcase from above. The main gallery is provided in the lower crankcase for supplying oil that is discharged from the oil pump to respective sections of the internal combustion engine. The oil supply passage is provided in the lower crankcase and supplies oil from the main gallery to a mating surface oil passage formed in the mating surface of the lower crankcase. The sub gallery is provided in the upper crankcase for guiding oil to a piston jet that injects oil toward a piston of the internal combustion engine. The oil communication passage is provided across the lower crankcase and the upper crankcase, branches from the oil supply passage to communicate with the sub gallery, and guides oil in the oil supply passage to the sub gallery.

According to the present invention, an oil communication passage branches from an oil supply passage, and is provided across a lower crankcase and an upper crankcase, and therefore can be simplified without having a complicated shape. The oil communication passage is not configured by a separate component from a crankcase, so that the number of components and the like can be reduced. Oil from a main gallery is guided to the piston jet through the oil supply passage, the oil communication passage and a sub gallery in the state where pressure of the oil is ensured. Consequently, piston cooling performance can be enhanced by the oil that is injected from the piston jet.

The nature and further characteristic features of the present invention will be described hereinafter in the following descriptions made with reference to the accompanying drawings, and the other advantages effects and functions of the present invention will be also made clear hereinafter.

DETAILED DESCRIPTION

Hereinafter, embodiments for carrying out the present invention will be described based on drawings.

Figure 1:
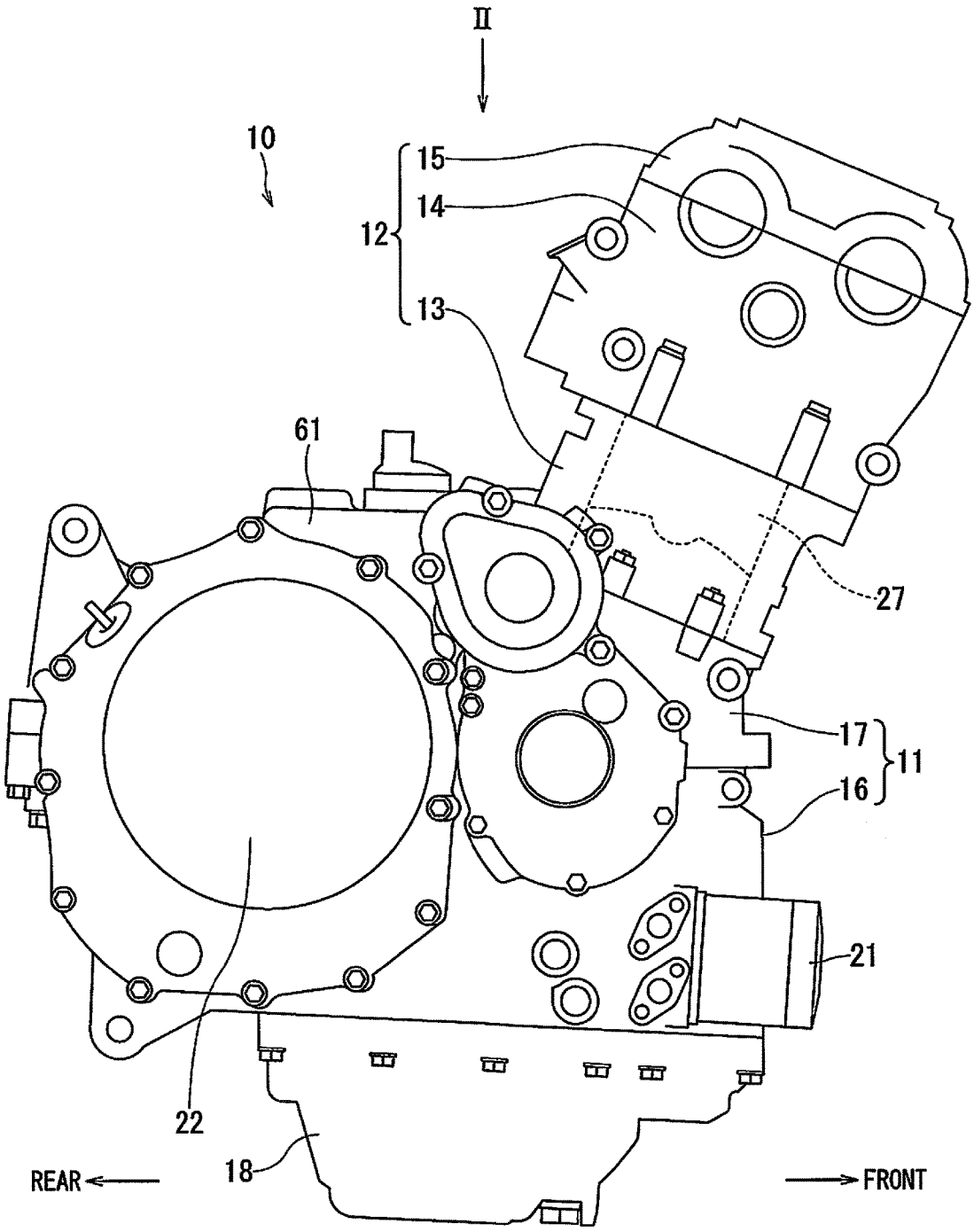
FIG. 1 is a right side view illustrating an engine to which an embodiment of a lubrication structure for an internal combustion engine according to the present invention is applied.
Figure 2:
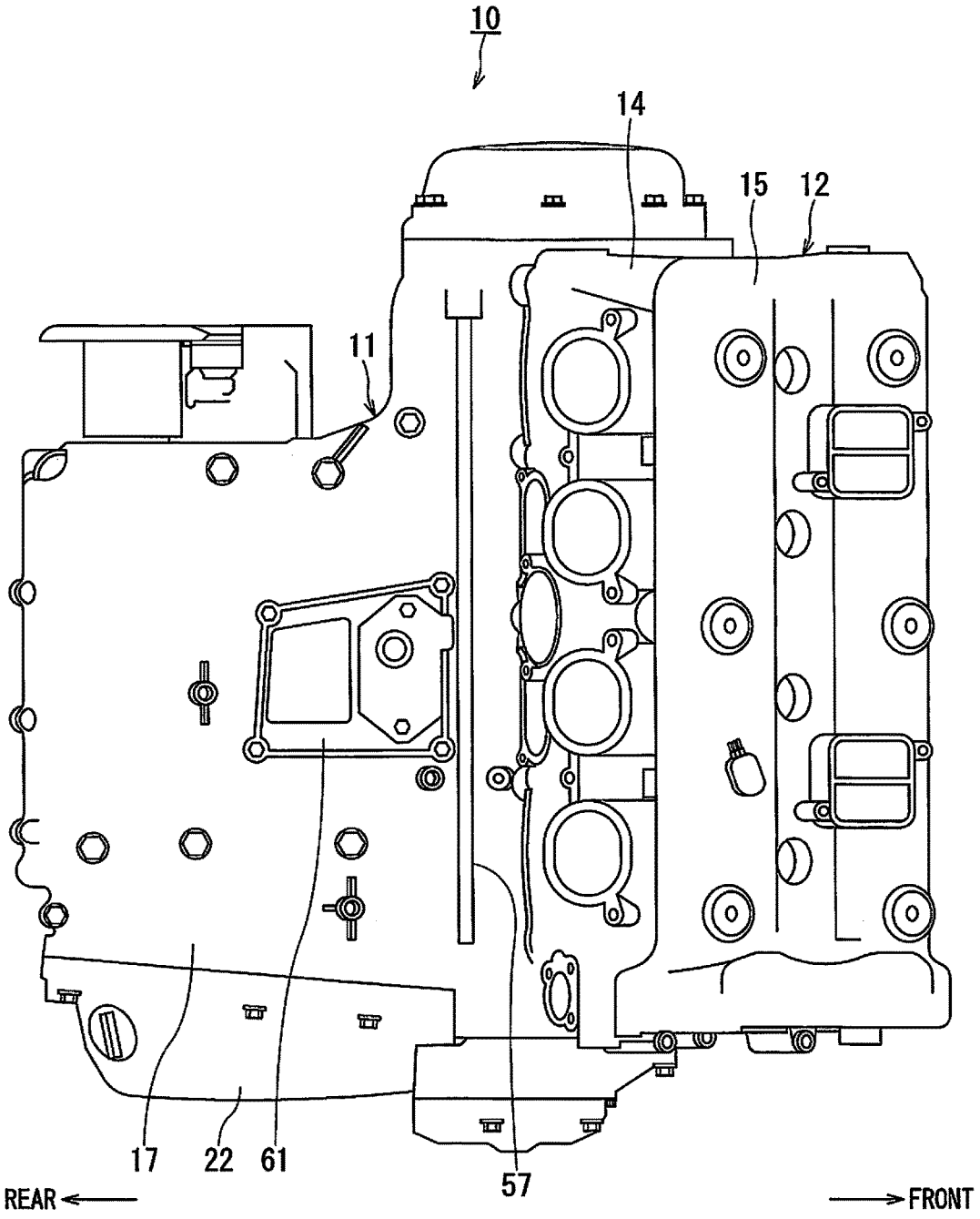
FIG. 2 is a view seen from arrow II in FIG. 1.

FIG. 1 is a right side view illustrating an engine to which an embodiment of a lubrication structure for an internal combustion engine according to the present invention is applied. FIG. 2 is a view seen from arrow II in FIG. 1. An engine 10 as the internal combustion engine illustrated in FIGS. 1 and 2 is to be loaded on a motorcycle, for example, and a cylinder assembly 12 is connected to a crankcase 11 by being tilted forward.

The cylinder assembly 12 is configured by a cylinder block 13, a cylinder head 14 and a head cover 15 being sequentially connected from below. By combustion of mixture gas that is supplied to a combustion chamber (not illustrated) in the cylinder head 14, a piston 27 reciprocates in the cylinder block 13, and the reciprocation rotates a crankshaft 23 (FIG. 3) via a connecting rod not illustrated.

Figure 3:
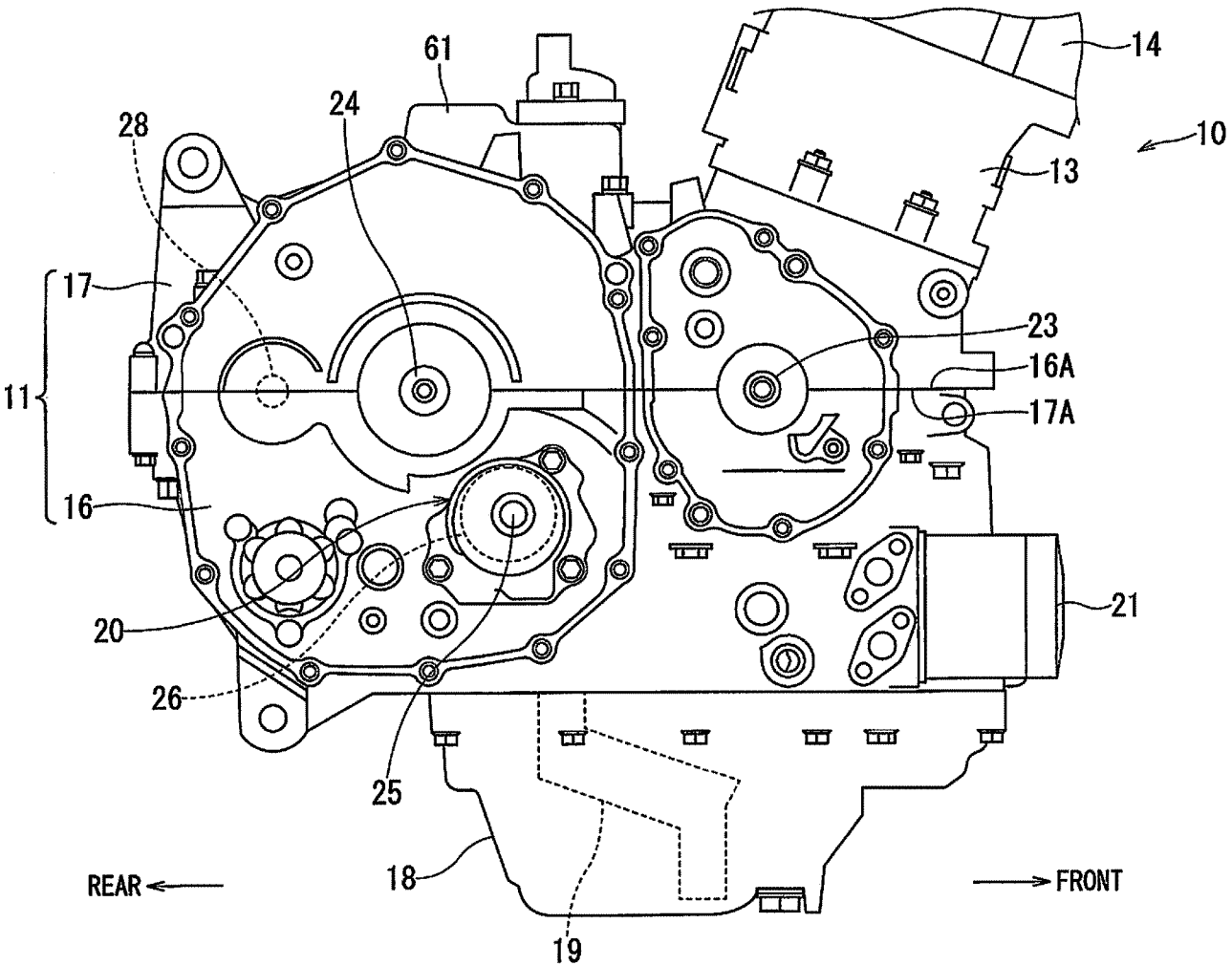
FIG. 3 is a right side view illustrating the engine by removing a clutch cover and the like in the engine in FIG. 1.

As is also illustrated in FIG. 3, the crankcase 11 is constructed by bringing a mating surface 17A of an upper crankcase 17 into contact with a mating surface 16A of a lower crankcase 16 from above, and connecting the upper crankcase 17 to the lower crankcase 16 in this state. An oil pan 18 that stores oil for engine lubrication is disposed at a lower part of the lower crankcase 16. An oil strainer 19 is placed in the oil pan 18.

An oil filter 21 is installed in a front part of the lower crankcase 16. An oil pump 20 is installed in a right side wall of the lower crankcase 16, in a state where the oil pump 20 is covered with a clutch cover 22. In the oil pump 20, a pump shaft 25 is driven by a rotational force of a countershaft 24 that is rotationally driven by a rotational force of the crankshaft 23 via a clutch mechanism not illustrated, and a pump rotor 26 rotating integrally with the pump shaft 25 rotates.

Figure 5:
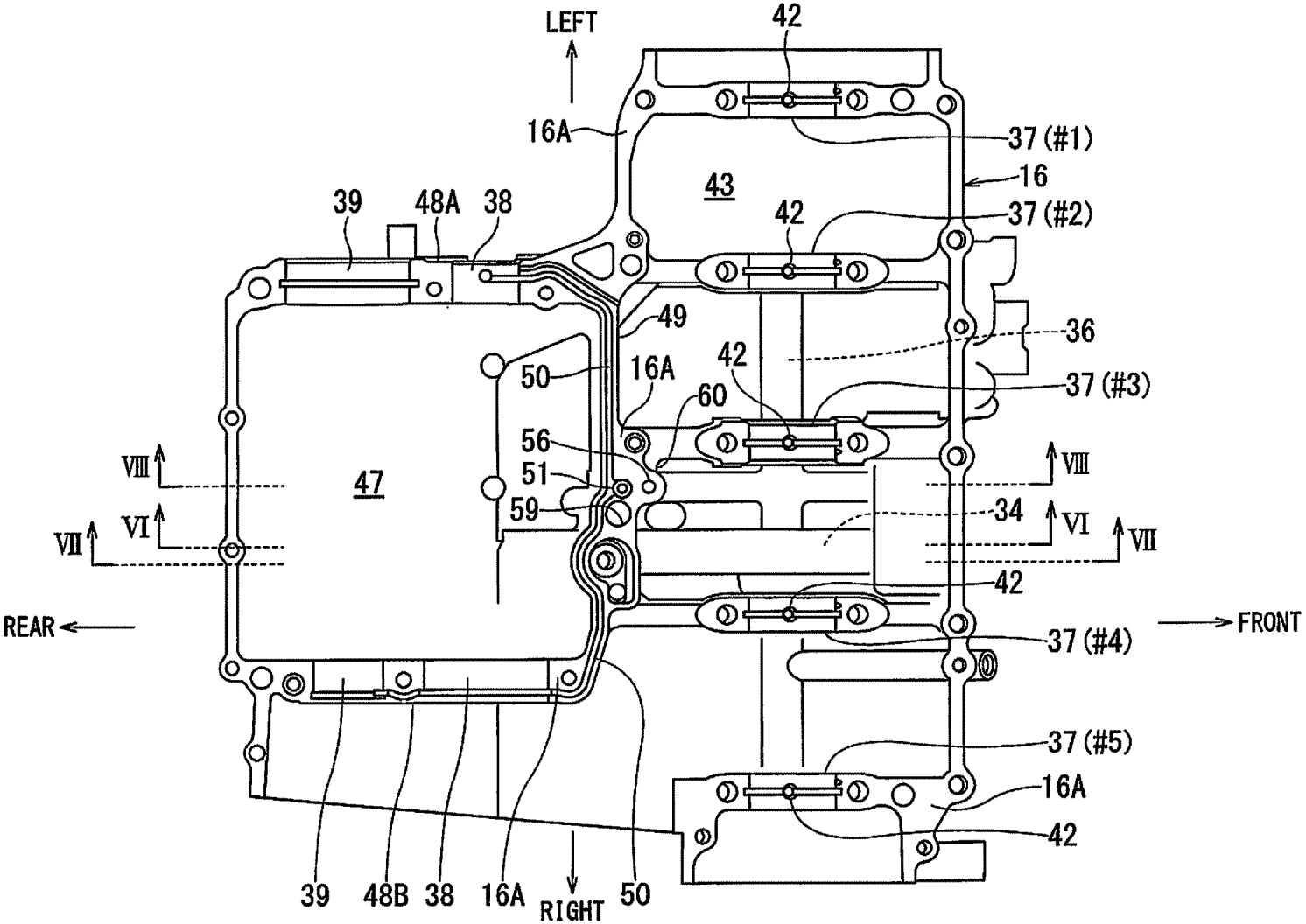
FIG. 5 is a plan view illustrating a lower crankcase by removing an upper crankcase in FIG. 4.
Figure 6:
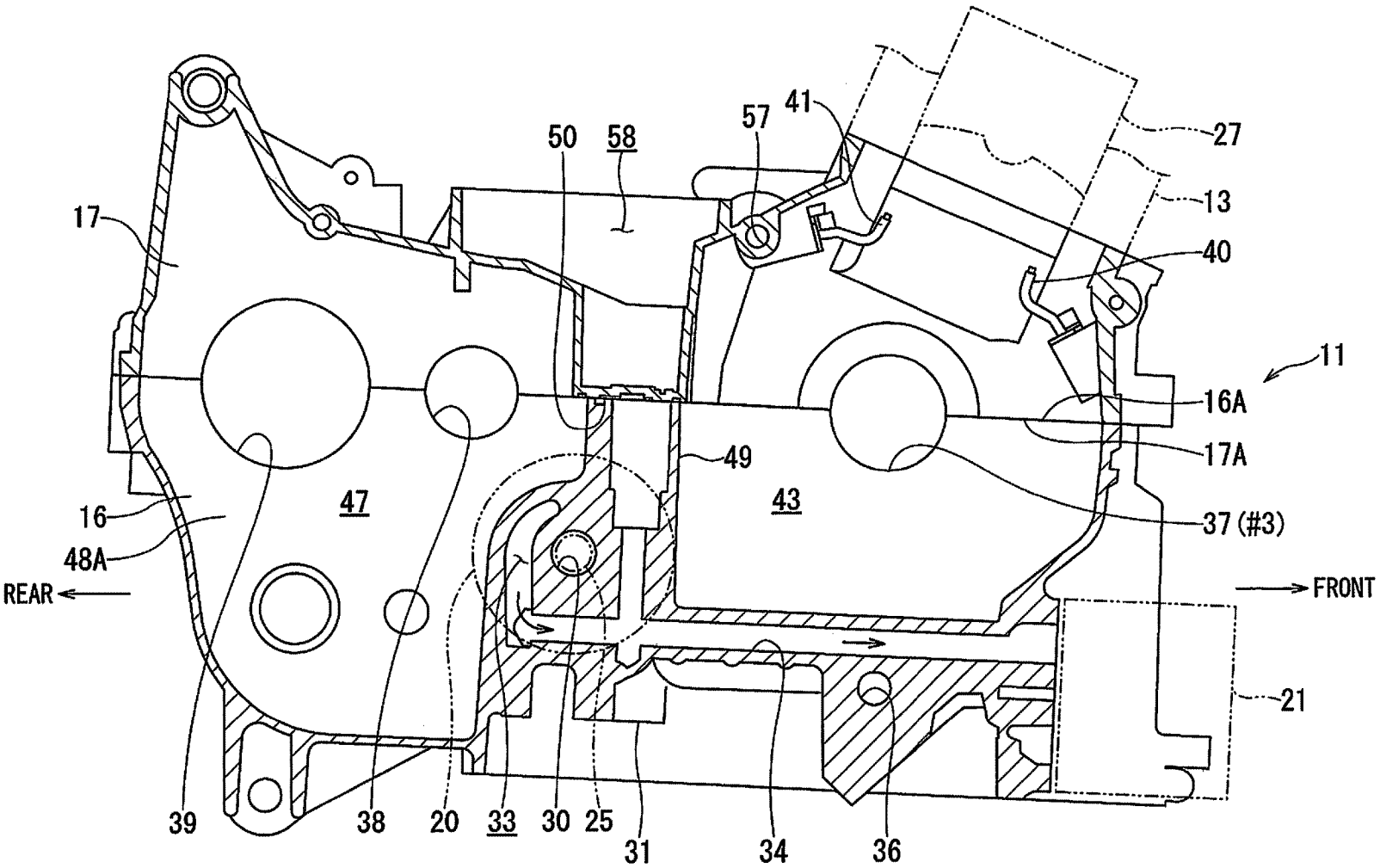
FIG. 6 is a sectional view taken along line VI-VI in FIGS. 4 and 5.

As illustrated in FIGS. 5 and 6, in the lower crankcase 16, a shaft insertion hole 30 through which the pump shaft 25 of the oil pump 20 is to be inserted, is provided. Further, in the lower crankcase 16, a second oil suction passage 32 (FIG. 9) is formed in one side region in a periphery of the shaft insertion hole 30, and a first oil discharge passage 33 is formed in the other side region, in such a manner that the second oil suction passage 32 and the first oil discharge passage 33 are respectively communicable with the oil pump 20.

The second suction passage 32 communicates with a first oil suction passage 31 formed in the lower crankcase 16 to extend in a vertical direction of the engine 10. The first oil suction passage 31 is provided to be connectable to the oil strainer 19 in the oil pan 18 (FIG. 3). As illustrated in FIGS. 5 and 6, the first oil discharge passage 33 communicates with a second oil discharge passage 34 formed in the lower crankcase 16 to extend in a horizontal direction of the engine 10. The second oil discharge passage 34 is provided to be connectable to the oil filter 21.

Figure 7:
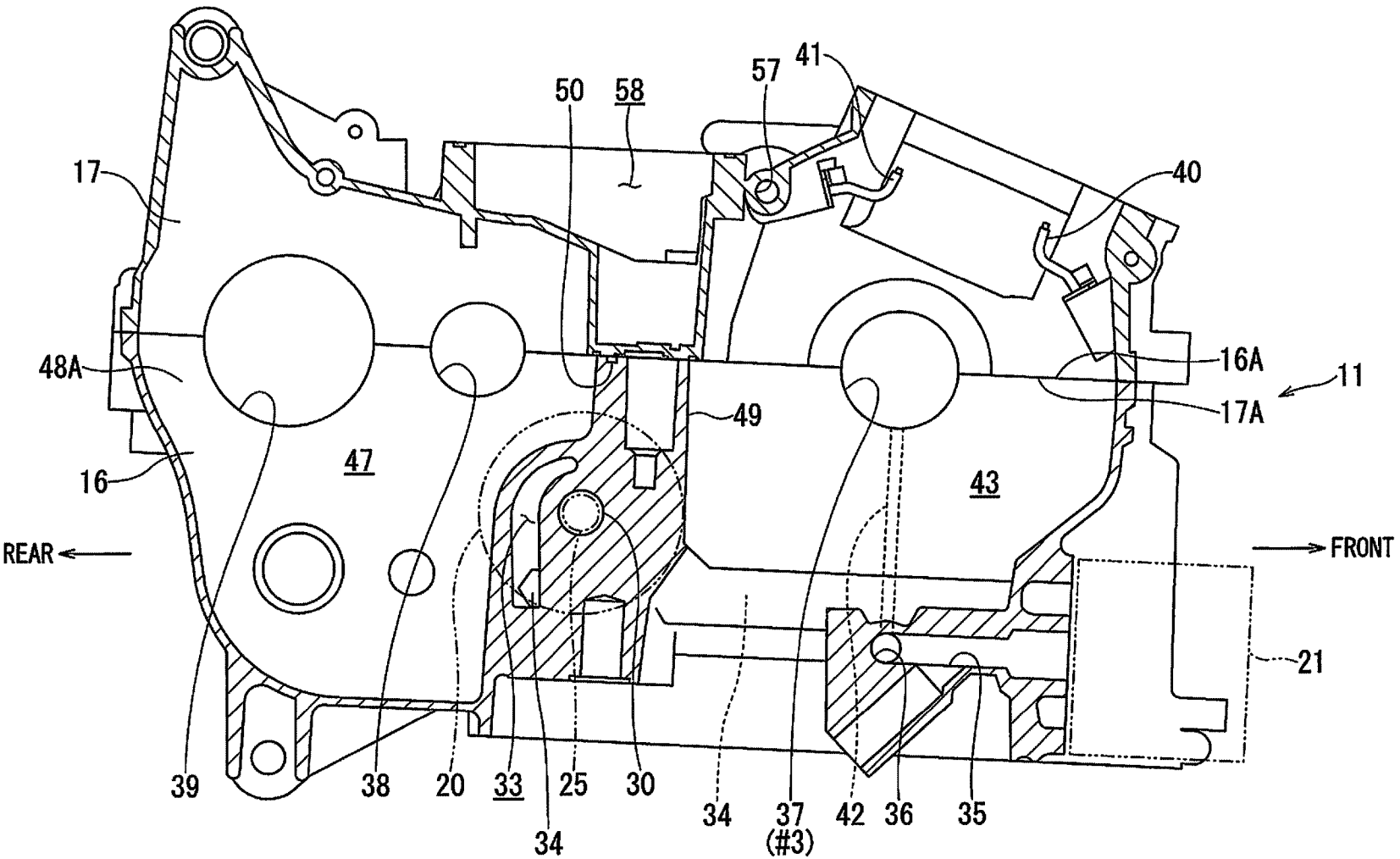
FIG. 7 is a sectional view taken along line VII-VII in FIGS. 4 and 5.

As illustrated in FIG. 7, in the lower crankcase 16, an oil ejection passage 35 connectable to the oil filter 21 is formed parallel with the second oil discharge passage 34. Further, as illustrated in FIGS. 5 and 7, in the lower crankcase 16, a main gallery 36 communicating with the oil ejection passage 35 extends horizontally in a lateral width direction of the engine 10, and is formed to be orthogonal to the oil ejection passage 35.

Figure 9:
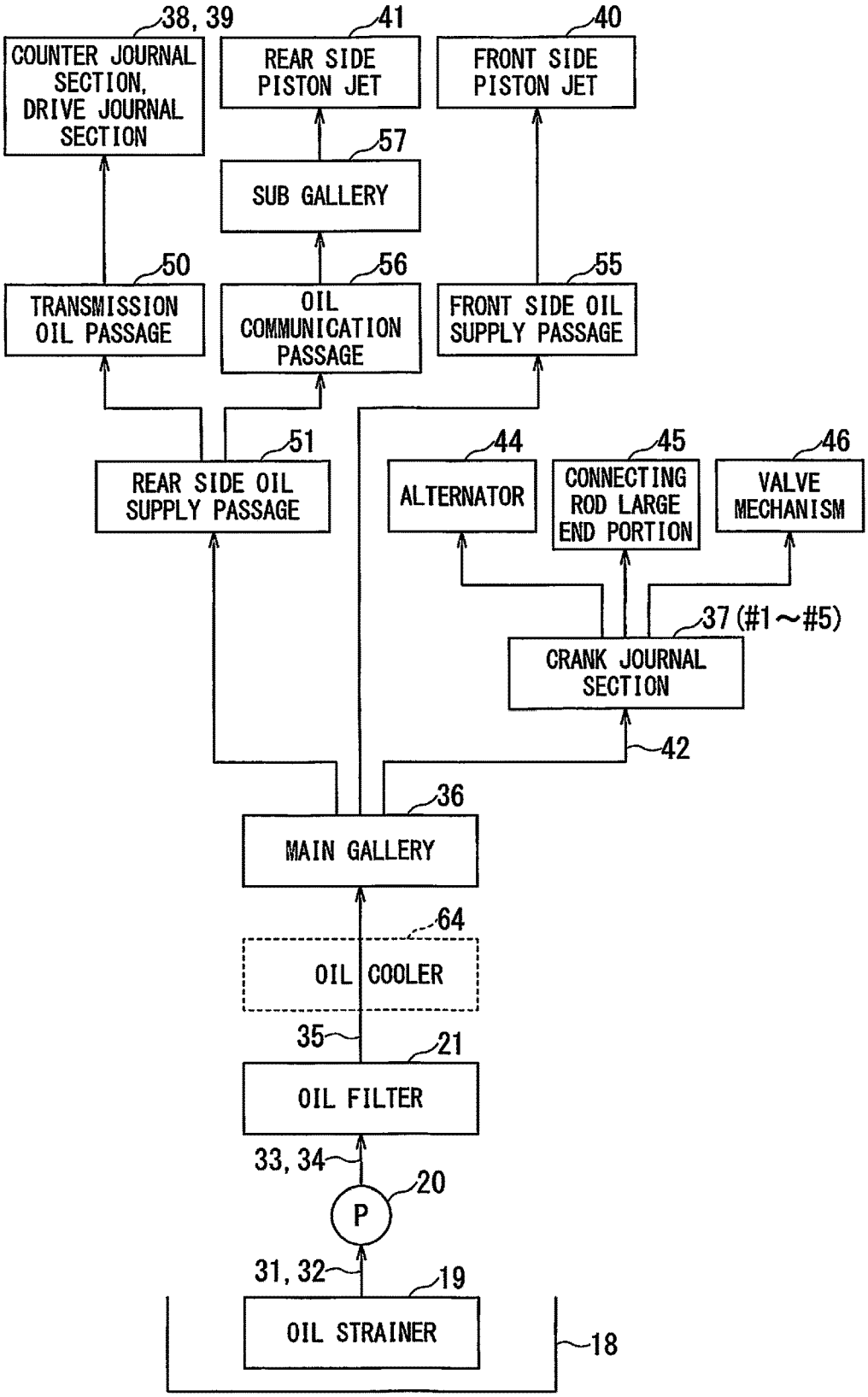
FIG. 9 is a system diagram illustrating a lubrication system in the engine in FIG. 1.

As illustrated in FIGS. 3 and 9, the pump rotor 26 of the oil pump 20 rotates, whereby oil in the oil pan 18 sequentially flows in the first oil suction passage 31 and the second oil suction passage 32 through the oil strainer 19, and is sucked into the oil pump 20 and pressurized. The pressurized oil is discharged to the first oil discharge passage 33 as illustrated in FIGS. 6 and 9, flows through the second oil discharge passage 34 and flows into the oil filter 21 to be filtered. As illustrated in FIGS. 7 and 9, the filtered oil flows into the main gallery 36 through the oil ejection passage 35, and is supplied to respective sections of the engine 10 from the main gallery 36.

The respective sections of the engine 10 to which oil is supplied include, for example, a crank journal section 37, a counter journal section 38, a drive journal section 39, a front side piston jet 40, rear side piston jet 41 and the like.

Figure 4:
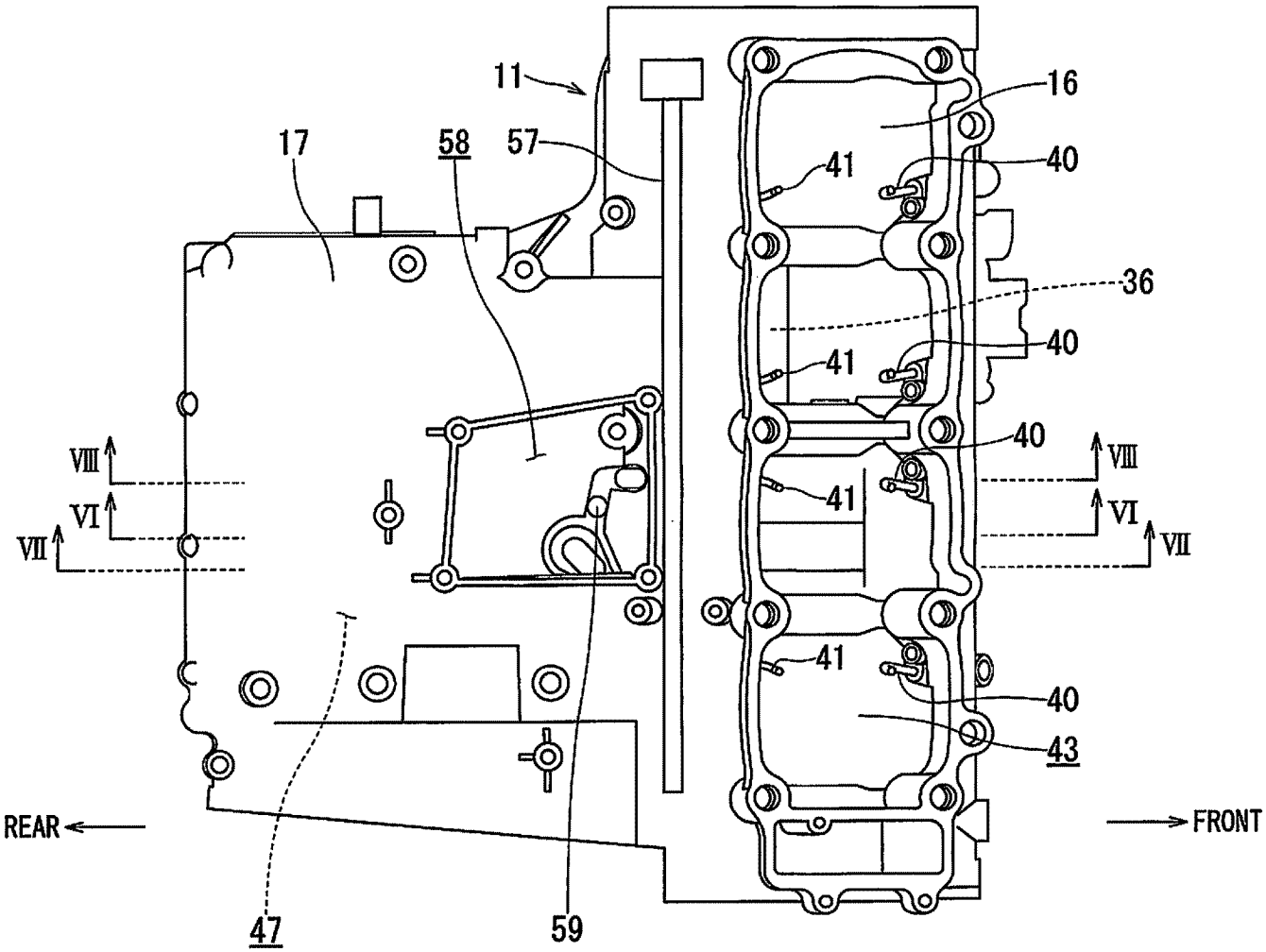
FIG. 4 is a plan view illustrating the engine by removing a cylinder assembly in the engine in FIG. 2.

The crank journal section 37 illustrated in FIG. 5 is a site that rotatably supports the crankshaft 23. The engine 10 is an in-line four-cylinder engine as illustrated in FIGS. 2 and 4, so that as the crank journal section 37, a first crank journal section #1, a second crank journal section #2, a third crank journal section #3, a fourth crank journal section #4 and a fifth crank journal section #5 are sequentially formed in the lower crankcase 16 at predetermined intervals in the lateral width direction of the engine 10 from a left side of the engine 10.

As illustrated in FIGS. 5 and 7, the respective crank journal sections 37 (the first crank journal section #1 to the fifth crank journal section #5) communicate with the main gallery 36 via a crank journal oil passage 42. These crank journal sections 37 (the first crank journal section #1 to the fifth crank journal section #5) are provided in a crank chamber 43 in the crankcase 11.

The respective crank journal sections 37 (the first crank journal section #1 to the fifth crank journal section #5) include journal metals (not illustrated) between the respective crank journal sections 37 and the crankshaft 23. To the respective crank journal sections 37 (the first crank journal section #1 to the fifth crank journal section #5), oil is supplied with suitable oil pressure from the main gallery 36 through the crank journal oil passage 42 so that an oil film is not discontinued between the journal metals and the crankshaft 23.

As illustrated in FIG. 9, oil that is supplied to the respective crank journal sections 37 from the main gallery 36 and lubricates the respective crank journal sections 37 is supplied to an alternator 44 and lubricates the alternator 44 in the case of the first crank journal section #1. In the case of the second crank journal section #2 and the fourth crank journal section #4, the oil after lubricating the respective crank journal sections 37 is supplied to a connecting rod large end portion 45, and lubricates sliding portions of the connecting rod large end portion 45 and the crankshaft 23. In the case of the fifth crank journal section #5, the oil after lubricating the respective crank journal sections 37 is supplied to a valve mechanism 46 in the cylinder head 14 and lubricates the valve mechanism 46. Oil after lubricating the third crank journal section #3 is not supplied to other places.

Counter journal sections 38 illustrated in FIG. 5 rotatably support the countershaft 24 (FIG. 3) of the transmission mechanism, and drive journal sections 39 illustrated in FIG. 5 rotatably support the drive shaft 28. The counter journal sections 38 and the drive journal sections 39 are provided in the transmission chamber 47 in the crankcase 11. Of them, the counter journal sections 38 are respectively formed on side walls 48A and 48B that define the transmission chamber 47 in the lower crankcase 16 and face each other. The drive journal sections 39 are also formed on the side walls 48A and 48B facing each other in the lower crankcase 16 to be adjacent to the counter journal sections 38.

In the lower crankcase 16, a partition wall 49 that separates the crank chamber 43 and the transmission chamber 47 is formed continuously to the side walls 48A and 48B. On the mating surface 16A of the lower crankcase 16, in the mating surface 16A at the side wall 48A, the partition wall 49 and the side wall 48B, a transmission oil passage 50 as a mating surface oil passage is formed to communicate with the counter journal sections 38 and the drive journal sections 39.

Figure 8:
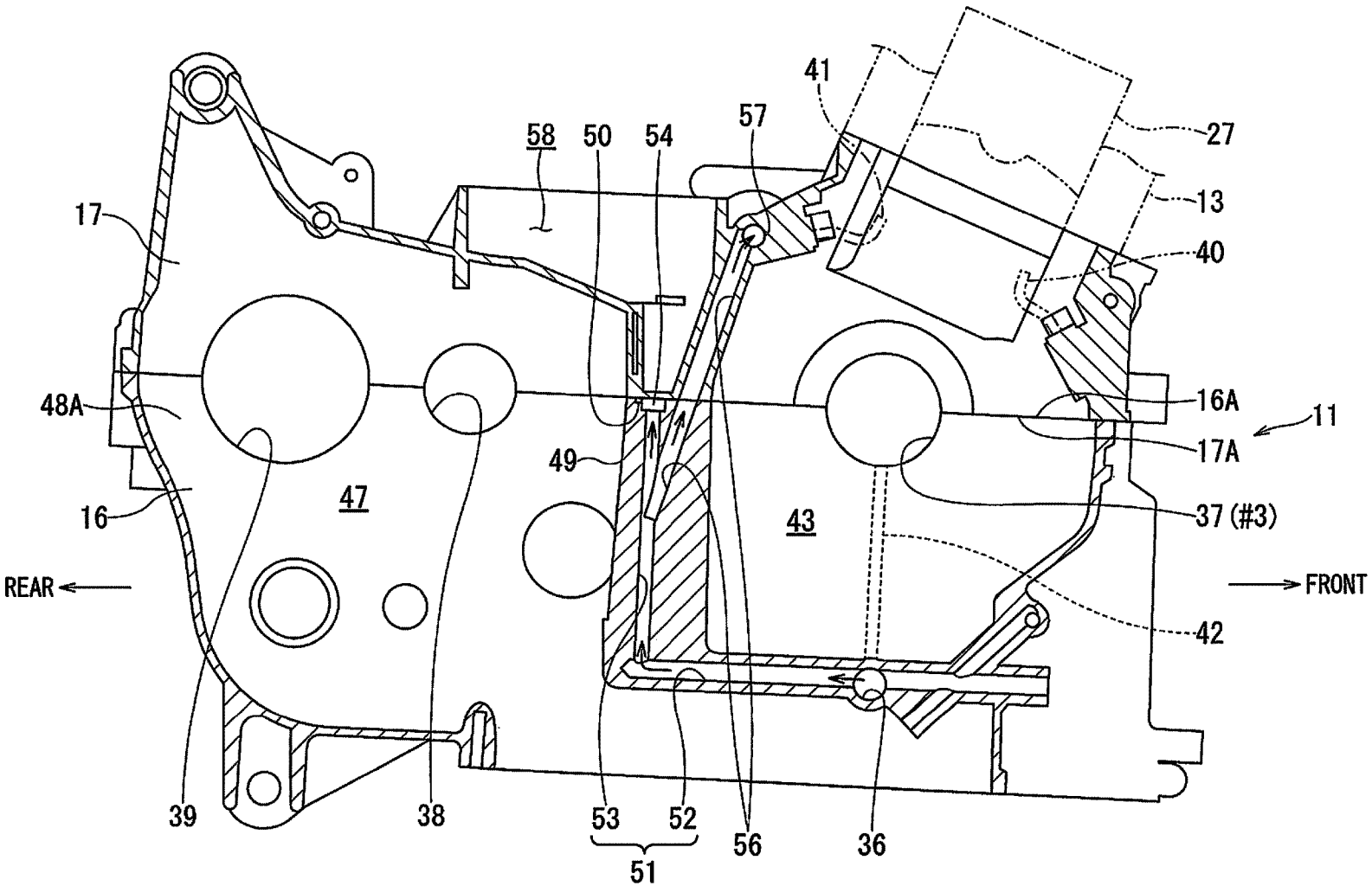
FIG. 8 is a sectional view taken along line VIII-VIII in FIGS. 4 and 5.

As illustrated in FIGS. 5 and 8, the transmission oil passage 50 communicates with the main gallery 36 via a rear side oil supply passage 51. The rear side oil supply passage 51 is formed in a central position in the lateral width direction of the engine 10 in the lower crankcase 16. Further, the rear side oil supply passage 51 has a horizontal extension passage section 52 that is formed in the lower crankcase 16 to communicate with the main gallery 36 and extend in the horizontal direction parallel with the mating surface 16A of the lower crankcase 16, and a vertical extension passage section 53 that is formed in the lower crankcase 16 to communicate with the horizontal extension passage section 52 and the transmission oil passage 50 and extend in the vertical direction with respect to the mating surface 16A of the lower crankcase 16.

Accordingly, as illustrated in FIGS. 8 and 9, the oil from the main gallery 36 sequentially flows through the horizontal extension passage section 52 of the rear side oil supply passage 51, and the vertical extension passage section 53, and is supplied to the transmission oil passage 50 illustrated in FIG. 5 through an orifice 54 that will be described later. The oil which is supplied to the transmission oil passage 50 is guided to the counter journal section 38 and the drive journal section 39, and lubricates sliding sites of the countershaft 24 and the counter journal section 38, and sliding sites of the drive shaft 28 and the drive journal section 39 respectively.

The above described orifice 54 is disposed in a boundary site from the transmission oil passage 50, for example, in the vertical extension passage section 53 of the rear side oil supply passage 51. The orifice 54 reduces the oil pressure of the oil which is supplied to the transmission oil passage 50 from the rear side oil supply passage 51, and prevents leakage of the oil that flows in the transmission oil passage 50.

As illustrated in FIGS. 4, 6 and 7, in the engine 10 of the present embodiment, a front side piston jet 40 and a rear side piston jet 41 are disposed in each cylinder. Oil is injected to a back surface of the piston 27 from the front side piston jet 40 and the rear side piston jet 41, and thereby the piston 27 under a high thermal load is cooled.

The front side piston jet 40 and the rear side piston jet 41 are installed in a position under the cylinder block 13 connected to the upper crankcase 17, in the upper crankcase 17 in the present embodiment. The front side piston jet 40 is positioned in a front position with respect to the piston 27, and the rear side piston jet 41 is positioned in a rear position with respect to the piston 27, respectively. Thereby, the front side piston jet 40 injects oil to a front side in the back surface of the piston 27, and the rear side piston jet 41 injects oil to a rear side in the back surface of the piston 27 respectively.

As illustrated in FIGS. 7 and 9, oil is supplied to the front side piston jet 40 from the main gallery 36 through a front side oil supply passage 55 formed at a front side of the lower crankcase 16. The front side oil supply passage 55 is formed across the lower crankcase 16 and the upper crankcase 17, in the central position in the lateral width direction of the engine 10.

As illustrated in FIGS. 8 and 9, oil is supplied to the rear side piston jet 41 from the main gallery 36 through the rear side oil supply passage 51, an oil communication passage 56 that is branched from the rear side oil supply passage 51, and a sub gallery 57 that communicates with the oil communication passage 56 and the rear side piston jet 41. The oil communication passage 56 is formed linearly across the lower crankcase 16 and the upper crankcase 17, and communicates with the vertical extension passage section 53 of the rear side oil supply passage 51 and the sub gallery 57. Further, the oil communication passage 56 is positioned in the central position in the lateral width direction of the engine 10. The oil communication passage 56 and the rear side oil supply passage 51 are provided in a same vertical plane in the lower crankcase 16.

The orifice 54 as a constriction portion is installed at a downstream position of a spot where the oil communication passage 56 branches, in the vertical extension passage section 53 of the rear side oil supply passage 51. Consequently, oil pressure of the main gallery 36 is ensured for the oil that flows in the oil communication passage 56, and in this state, oil is introduced into the sub gallery 57 from the oil communication passage 56.

As illustrated in FIGS. 4 and 8, the sub gallery 57 is formed throughout a substantially entire longitudinal width of the upper crankcase 17 along the lateral width direction of the engine 10, in an upper part of the upper crankcase 17. Further, the sub gallery 57 is disposed between the vertical extension passage section 53 of the rear side oil supply passage 51 and the main gallery 36 in side view of the engine 10. The oil communication passage 56 communicates with a central position in the lateral width direction of the engine 10 in the sub gallery 57. The respective rear side piston jets 41 installed in correspondence with the respective cylinders communicate with the sub gallery 57. Thereby, the oil which reaches the sub gallery 57 through the rear side oil supply passage 51 and the oil communication passage 56 from the main gallery 36 is supplied to the rear side piston jets 41.

Here, as illustrated in FIG. 5, the aforementioned oil communication passage 56 is disposed closely to the third crank journal section #3 of the crank journal section 37. The transmission chamber 47 is behind the third crank journal section #3, and a large space is provided. The side wall 48A is disposed behind the second crank journal section #2, and the side wall 48B is disposed behind the fourth crank journal section #4 respectively, whereby strength and rigidity of the second crank journal section #2 and the fourth crank journal section #4 are ensured. In relation to this, the third crank journal section #3 is disposed closely to the oil communication passage 56, whereby it becomes possible to form a thickened reinforcement portion 60 in a curved shape between the third crank journal section #3 and a peripheral portion of the oil communication passage 56. Consequently, strength and rigidity of the third crank journal section #3 are enhanced by the thickened reinforcement portion 60.

As illustrated in FIGS. 4, 7 and 8, in an upper part of the upper crankcase 17, a breather chamber 58 that separates oil in blowby gas is provided integrally with the upper crankcase 17 adjacently to a rear of the sub gallery 57. The oil that is separated in the breather chamber 58 is returned to the oil pan 18 (FIG. 3) through an oil return passage 59 illustrated in FIGS. 4 and 5. The breather chamber 58 is covered with a breather chamber cover 61 (FIG. 2) installed in the upper crankcase 17 from above.

As configured as above, according to the present embodiment, the following effects (1) to (6) are exhibited.

(1) As illustrated in FIGS. 5 and 8, the oil communication passage 56 is provided across the lower crankcase 16 and the upper crankcase 17 by branching from the rear side oil supply passage 51 that supplies the oil from the main gallery 36 to the transmission oil passage 50 formed in the mating surface 16A of the lower crankcase 16. Subsequently, the oil is guided to the rear side piston jets 41 through the sub gallery 57 from the oil communication passage 56. In this way, the oil communication passage 56 branches from the existing rear side oil supply passage 51, is provided across the lower crankcase 16 and the upper crankcase 17, and therefore can be simplified without having a complicated shape. Further, the oil communication passage 56 is not configured by a separate component from the crankcase 11, and therefore, the number of components, the number of assembly steps, and the weight and cost of the engine 10 can be reduced.

The oil from the main gallery 36 is guided to the rear side piston jet 41 through the rear side oil supply passage 51, the oil communication passage 56 and the sub gallery 57 in the state where the oil pressure thereof is ensured. Consequently, the cooling performance for the piston 27 can be enhanced by the oil that is injected from the rear side piston jet 41 and the front side piston jet 40.

(2) The rear side oil supply passage 51 and the oil communication passage 56 are provided in the same vertical plane in the lower crankcase 16, and the positions in the lateral direction coincide with each other in the lower crankcase 16. Consequently, when the rear side oil supply passage 51 and the oil communication passage 56 are machined in the lower crankcase 16, the machining tool such as a drill can be only moved or inclined in only the longitudinal direction with respect to the lower crankcase 16, and the machining tool does not have to be moved in the lateral direction with respect to the lower crankcase 16. As a result, machining of the rear side oil supply passage 51 and the oil communication passage 56 can be facilitated. In addition, the rear side oil supply passage 51 and the oil communication passage 56 are provided in the same vertical plane in the lower crankcase 16, so that the passage length of the oil communication passage 56 is also shortened, and a machining time period for the oil communication passage 56 can be reduced.

(3) The rear side oil supply passage 51 and the oil communication passage 56 are provided in the crankcase 11 at the central position in the lateral width direction of the engine 10. Consequently, oil can be supplied to the transmission oil passage 50 equally on the left and right, from the rear side oil supply passage 51, and further, oil can be supplied to the sub gallery 57 equally on the left and right, from the oil communication passage 56.

(4) In the vertical extension passage section 53 of the rear side oil supply passage 51, the orifice 54 is provided in the downstream position (specifically, the boundary site from the transmission oil passage 50 in the vertical extension passage section 53 of the rear side oil supply passage 51) from the spot where the oil communication passage 56 branches. Consequently, excessive oil pressure does not act on the oil flowing to the transmission oil passage 50, so that leakage of the oil from the transmission oil passage 50 can be prevented. In addition, the oil pressure for injecting oil from the rear side piston jet 41 can be favorably ensured for the oil which is guided to the rear side piston jet 41 from the main gallery 36 through the rear side oil supply passage 51, the oil communication passage 56 and the sub gallery 57. Further, by selecting the orifice 54, adjustment of the oil pressure of the oil which is guided to the rear side piston jet 41 can be also performed easily.

(5) As illustrated in FIGS. 4 and 8, the sub gallery 57 is disposed between the vertical extension passage section 53 of the rear side oil supply passage 51 and the main gallery 36 in side view of the engine 10. Consequently, the rear side oil supply passage 51 and the oil communication passage 56 which communicate with the main gallery 36 and the sub gallery 57 as well as the main gallery 36 and the sub gallery 57 are in a fixed range in the longitudinal direction of the crankcase 11, so that the configuration of the aforementioned oil passage (the main gallery 36, the rear side oil supply passage 51, the oil communication passage 56 and the sub gallery 57) can be simplified. Consequently, machining of these oil passages (the main gallery 36, the rear side oil supply passage 51, the oil communication passage 56 and the sub gallery 57) can be also facilitated.

(6) In the crankcase 11, the oil passages (the rear side oil supply passage 51, the oil communication passage 56 and the sub gallery 57) that guide oil to the rear piston jet 41 from the main gallery 36 are all formed in the crankcase 11, and are not formed by separate components from the crankcase 11. Consequently, it becomes possible to provide the breather chamber 58 integrally with the upper crankcase 17 adjacently to the sub gallery 57. As a result, compactification of the engine 10 can be realized while a capacity of the breather chamber 58 is ensured.

While the embodiment of the present invention is described thus far, the embodiment is only presented as an example, and does not intend to limit the claims. The embodiment can be carried out in other various modes, and various omissions, replacements and changes can be made within the range without departing from the gist of the invention, and the replacements and changes are included in the claims and gist, and are included in the range of the invention described in the clams and equivalents thereof.

Figure 10:
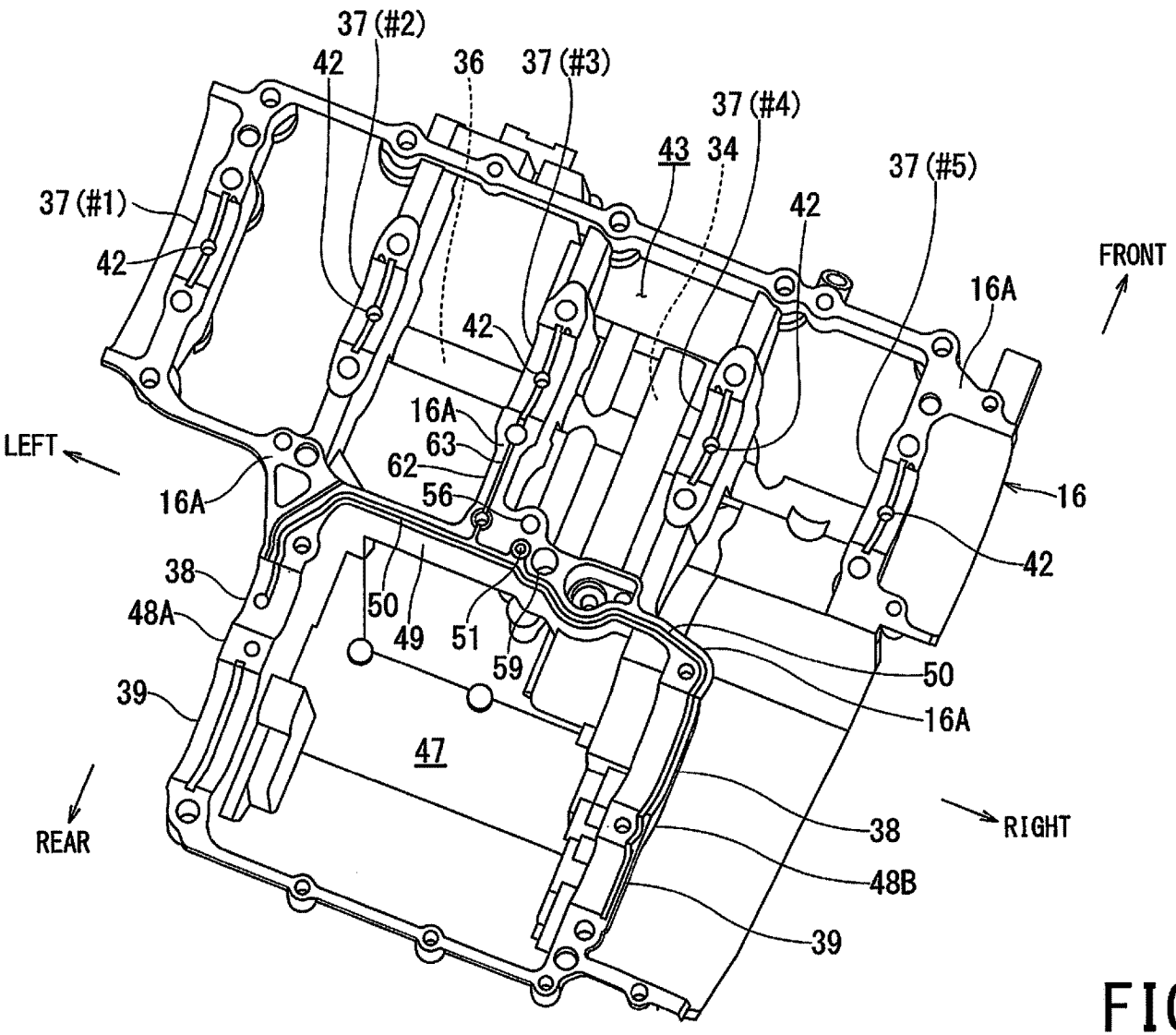
FIG. 10 is a perspective view illustrating a lower crankcase of an engine to which another embodiment of the lubrication structure for an internal combustion engine according to the present invention is applied.

For example, as illustrated in FIG. 10, the third crank journal section #3 of the crank journal section 37 and the partition wall 49 of the transmission chamber 47 may be connected by a connection portion 62, and the third crank journal section #3 and the transmission oil passage 50 may communicate with each other via a communication groove 63 formed in the mating surface 16A at the connection portion 62 in the lower crankcase 16. The communication groove 63 is configured by being surrounded by a recessed portion that is formed on the mating surface 16A when the lower crankcase 16 is molded and the mating surface 17A of the upper crankcase 17. Further, the communication groove 63 communicates with the transmission oil passage 50 in the central position in the lateral width direction of the engine 10.

The oil that lubricates the third crank journal section #3 is supplied to the transmission oil passage 50 through the aforementioned communication groove 63, whereby temperature rise in the third crank journal section #3 can be restrained, and the amount of the oil that is supplied to the counter journal section 38 and the drive journal section 39 from the transmission oil passage 50 can be sufficiently ensured. Further, the communication groove 63 communicates with the transmission oil passage 50 in the central position in the lateral width direction of the engine 10, the oil from the communication groove 63 can be supplied by being distributed equally to the left and right of the transmission oil passage 50. Further, the third crank journal section #3 and the partition wall 49 of the transmission chamber 47 are connected by the connection portion 62, whereby the third crank journal section #3 is reinforced, and strength and rigidity of the third crank journal section #3 can be enhanced.

As illustrated by a broken line in FIG. 9, after the oil that is filtered by the oil filter 21 is cooled by an oil cooler 64, the oil may be supplied to the main gallery 36. Further, the engine 10 which is an internal combustion engine is not limited to the engine that is loaded on a motorcycle, but may be an engine that is loaded on a four-wheel automobile, an outboard engine or a water vehicle, or a general-purpose engine.

The invention claimed is:

1. A lubrication structure for an internal combustion engine, comprising:

an oil pump that is installed in a crankcase configured by connecting an upper crankcase on a mating surface of a lower crankcase from above;

a main gallery provided in the lower crankcase, for supplying oil that is discharged from the oil pump to respective sections of the internal combustion engine;

an oil supply passage provided in the lower crankcase and supplying oil from the main gallery to a mating surface oil passage formed in the mating surface of the lower crankcase;

a sub gallery provided in the upper crankcase, for guiding oil to a piston jet that injects oil toward a piston of the internal combustion engine; and an oil communication passage provided across the lower crankcase and the upper crankcase, branching from the oil supply passage to communicate with the sub gallery, and guiding oil in the oil supply passage to the sub gallery.

2. The lubrication structure for an internal combustion engine according to claim 1, wherein the oil supply passage and the oil communication passage are provided in a same vertical plane in the crankcase.

3. The lubrication structure for an internal combustion engine according to claim 2, wherein the oil supply passage and the oil communication passage are provided in a central position in a lateral width direction of the internal combustion engine.

4. The lubrication structure for an internal combustion engine according to claim 1, wherein in the oil supply passage, a constriction portion is placed at a downstream position from a spot where the oil communication passage branches.

5. The lubrication structure for an internal combustion engine according to claim 1, wherein the oil supply passage includes a horizontal extension passage section that communicates with the main gallery and is provided in the lower crankcase to extend in a horizontal direction, and a vertical extension passage section that communicates with the horizontal extension passage section and the mating surface oil passage and is provided in the lower crankcase to extend in a vertical direction, and the sub gallery is disposed between the main gallery and the vertical extension passage section, in side view of the internal combustion engine.

6. The lubrication structure for an internal combustion engine according to claim 1, wherein in the upper crankcase, a breather chamber is provided adjacently to a rear of the sub gallery.

7. The lubrication structure for an internal combustion engine according to claim 1, wherein the piston jet to which oil is guided from the sub gallery is a rear side piston jet that injects oil toward a rear side of the piston.

8. The lubrication structure for an internal combustion engine according to claim 1, wherein the mating surface oil passage is a transmission oil passage that guides oil to respective journal sections that support a countershaft and a driveshaft of a transmission mechanism.

* * * * *